US005749290A

United States Patent [19]

Johnson et al.

[11] Patent Number: 5,749,290

[45] Date of Patent: May 12, 1998

[54] PRESS TRANSFER APPARATUS

[76] Inventors: Lawrence A. Johnson, 9041 N. Fielding Rd., Bayside, Wis. 53217; Heinz H. Schmeisser, 3437 S. Crandon Pl., Greenfield, Wis. 53219

[21] Appl. No.: 717,245

[22] Filed: Sep. 20, 1996

[51] Int. Cl.[6] ..... B30B 15/30

[52] U.S. Cl. ..... 100/207; 72/405.13; 72/405.16; 100/215; 198/621.4; 414/751

[58] Field of Search ..... 100/207, 215, 100/218; 72/405.11, 405.16, 405.13; 414/751; 198/621.1–621.4

[56] References Cited

U.S. PATENT DOCUMENTS

| | | | |
|---|---|---|---|
| 4,511,029 | 4/1985 | Okawa | 198/621.2 |
| 4,577,748 | 3/1986 | Boegner et al. | 72/405.13 |
| 4,741,195 | 5/1988 | Arai et al. | 72/405.13 |
| 4,819,786 | 4/1989 | Tanaka et al. | 72/405.13 |
| 5,267,463 | 12/1993 | Doyama | 72/405.16 |
| 5,562,196 | 10/1996 | Zierpka et al. | 72/405.16 |
| 5,617,756 | 4/1997 | Thudium et al. | 72/405.16 |

OTHER PUBLICATIONS

Advanced Automation for Parts Transfer in the Metal Industry, "Intelligente Automationstechnik für Umformpressen", GPA–JAKOB, no date, 8 pages.

Livernois Die & Automation, "Servo–Controlled Transfers The Most Versatile Units in the World", 1994, 8 pages.

Rayer Transfertechnik, no date, 4 pages.

Pressen Automation—GPA, "Transfer systems for metal forming for new press equipment, retrofit of existing presses and interlinking of presses", no date, 8 pages.

*Primary Examiner*—Stephen F. Gerrity
*Attorney, Agent, or Firm*—Hill, Steadman & Simpson

[57] ABSTRACT

A multi-station press is provided with a press transfer device that engages articles at the press stations after processing and transfers the articles to the next station before the press performs its next press cycle. The press transfer device includes a pair of elongated transfer bars extending along the transfer directions of the press, and grippers or other article engaging elements mounted along the transfer bars to engage the articles for transfer. The transfer bars are moved together by a grip moving unit to engage the articles, the transfer bars are lifted by a lifter, the transfer bars are then moved endwise by an endwise moving unit to the next press station. The lifter then lowers the bars and the grip moving unit moves the bars apart to disengage the articles, thereby leaving the articles at the next station. The grip moving unit ensures that the transfer bars are moved far enough apart so as not to interfere with the press during the next press cycle.

10 Claims, 4 Drawing Sheets

PRESS TRANSFER APPARATUS

BACKGROUND OF THE INVENTION

1. Field of the Invention

The present invention relates generally to a device for transferring articles from one station to another in a multiple station press.

2. Description of the Related Art

Power presses for forming articles may have multiple stations in a single press to form the articles, wherein each station performs a different step in the progressive shaping of the finished article. The articles must be moved from one station to the next in such multi-station presses. The press stations are arranged along a transfer line with the first station performing the first step in the article formation and subsequent stations along the line performing each progressive step until the completed article is moved out of the endmost station. Several articles are usually processed at one time, each at a different press station. Automatic means are provided for feeding the raw article to the first station and for removing the finished articles from the last station.

According to the known way of performing the transfer of articles from one press station to the next, elongated gripper bars extend parallel to the direction of the transfer line of press stations and are positioned between the upper and lower press portions. The bars have gripper fingers or other article engaging means which engage all of the articles at one time when the bars are brought together. The gripper bars and the engaged articles are lifted and moved endwise until each article is at the next press station. The gripper bars and the engaged articles are then lowered and moved apart, so that the articles are deposited at the next station in the progressive press operation.

The press operates in cycles that include lowering the press head, or ram, toward a bolster plate in which is held the dies, pressing or forming the articles and then lifting the press head from the bolster plate. The articles are moved from one station to the next while the press portions are apart. The gripper bars with the article engaging means may then be moved between the press portions to perform the article transfer without interfering with the press operation. The gripper bars are moved apart onto either side of the press during the pressing portion of the cycle so as to be clear of the press. The transfer of the articles must therefore be coordinated with the press cycles.

The coordination of the transfer is accomplished according to the known press transfer devices by forming a mechanical linkage to the press mechanism. This mechanical linkage requires custom parts and design for each make and model of press, and possibly for different press installations where space or clearance is a concern, for example. The linkage is thus expensive, requires time consuming set up and configuration, and is prone to breakdowns.

The mechanism to carry out the transfer is also of a complex mechanical configuration, requiring various levers and cams and the like. The mechanism for transfer must be able to move the transfer bars together, lift them, and move them endwise, and them move the bars out of the path of the press. The known devices for performing the transfer operation are relatively large, complex and subject to frequent breakage, resulting in high initial cost and high repair cost. Further, the transfer devices are slower than the maximum press cycle speed, so the presses have to be slowed or the cycles stopped to accommodate the speed of the press transfer mechanisms.

SUMMARY OF THE INVENTION

An object of the present invention is to transfer articles from one station to another in a power press at a high rate of speed using few moving parts and high efficiency.

Another object is to reduce the complexity, size and failure rate of press transfer devices so as to reduce costs of maintenance and repair.

Yet a further object of the invention is to permit presses to operate at full cycle speed without stopping between cycles by increasing the possible operating speed of the transfer device.

Yet another object of the present invention is to provide a compact press transfer device which fits conveniently within the structure of a multi-station press.

These and other objects of the invention are achieved by a press transfer device which includes, in general, a pair of gripper bars extending along the transfer line of the multi-station press, the gripper bars having gripper elements at intervals along their length to engage the articles being worked by the press. Gripper means for moving the gripper bars together so as to engage the articles and then for moving the gripper bars apart to disengage the articles is provided. Once the gripper bars are moved together, lifter means is provided for lifting the gripper bars to lift the gripped articles. The gripper bars are then moved endwardly by means for transferring to relocate the articles from one station to the next. The lifter means then lowers the gripper bars and the gripper bars are moved apart to release the articles at the new stations and to move the gripper bars out of the path of the press for the next pressing cycle.

The lifter means for lifting and lowering articles for transfer, includes a horizontal bearing between a first member and a second member, a vertical bearing between the first member and a third member, and a diagonal bearing between the second member and the third member. Horizontal motion of the second member, as affected by an actuator connected to move the second member, relative to the first member results in vertical motion of the third member. The gripper bars are lifted by the third member. In an embodiment of the invention, a pair of the lifter means is provided, one near each end of the gripper bars.

Specifically, the three members of the lifter means are connected by linear bearings that have little play, so very little lost motion results. The efficiency of the means for lifting and lowering is very high since only a few moving parts are required. The simplicity of the lifting and lowering device also provides for a compact design and easy repair.

The lifter means for lifting and lowering the articles provides the lifting motion of the transfer system that also includes the gripper means for bringing the gripper bars together and apart. The gripper means are provided, at least in part, on the third member of the lifting and lowering means so that the gripper bars are brought together to grip the articles before the lifting, continue to engage the articles during lifting, transfer and lowering and then disengage the articles after transfer to the next station.

The gripper means may be mounted entirely on the third member of the lifter means, or may have the drive means for the gripper means stationarily mounted and a linkage to slides on the third member.

Also included in the present transfer apparatus is a means for transferring the gripped and lifted articles from one press station to another press station by moving the gripper bars endwise. This component is separate from the lifter means and gripper means and only one such transfer means is provided, preferably mounted at one end of the gripper bars.

Each of the components of the transfer system is operated under the control of a numeric controller to coordinate the relative movements with one another and with the press.

DETAILED DESCRIPTION OF THE PREFERRED EMBODIMENTS

Figure 1:
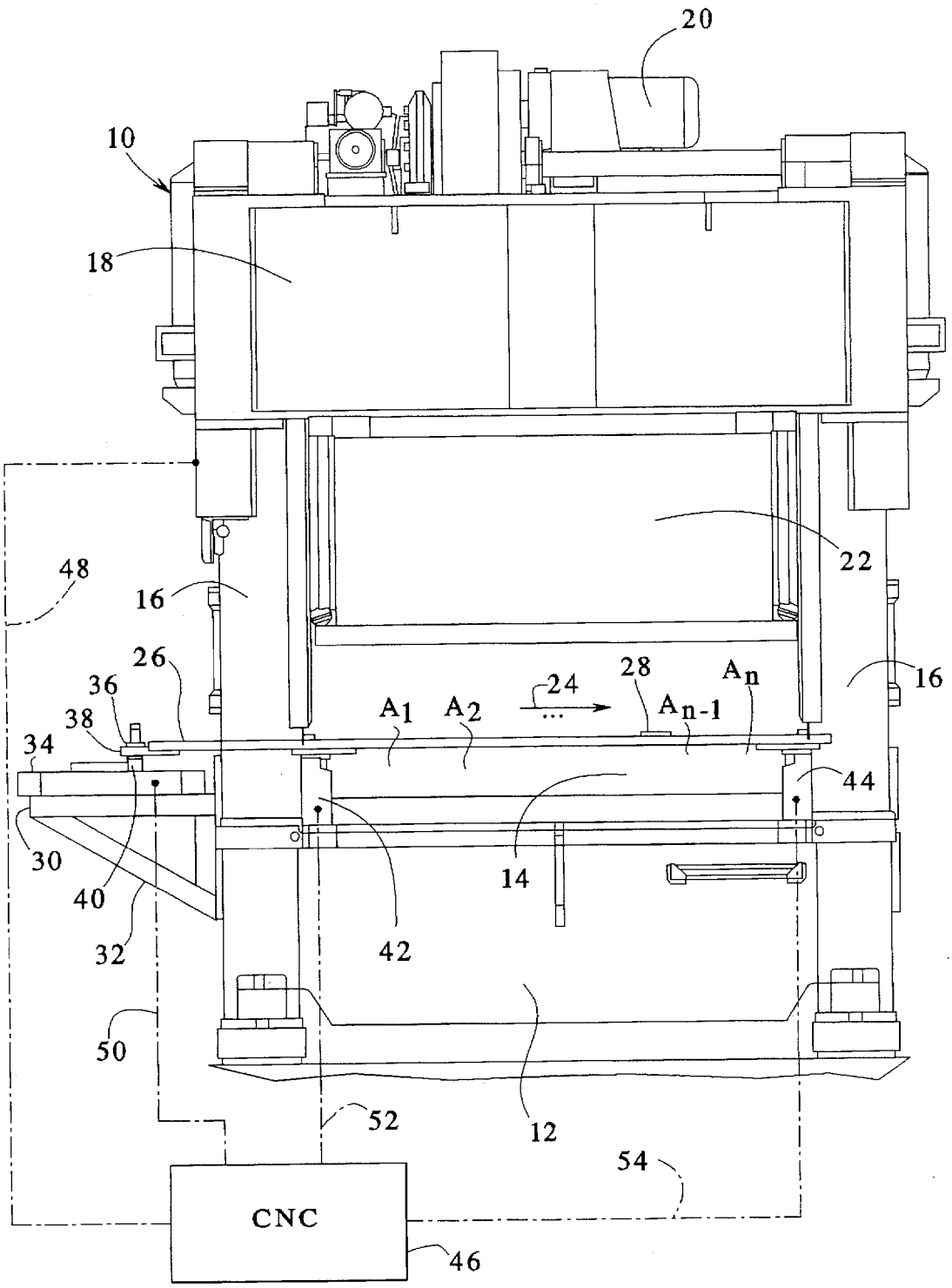
FIG. 1 is a side view of a multiple station press on which a press transfer device according to the present invention has been mounted.

Referring first to FIG. 1, a power press 10 is shown having a press bed 12 on which is mounted a bolster plate 14 which holds the dies of the press. The illustrated press is made by Minster, although the present invention may be used on any press. A pair of uprights 16 support the top portion 18 of the press which includes a press drive 20 that drives a ram 22. The press 10 is a multi-station press which has a plurality of stations $A_1$–$A_n$ for processing articles in sequence along a transfer direction 24. The articles are initially fed into the first station $A_1$, for a first processing step, and then are transferred to each subsequent station $A_2, A_3, \ldots A_{n-1}, A_n$ for further processing until the final station $A_n$ is reached. The processed article is then removed from the multi-station press 10. The number of articles being processed simultaneously corresponds to the number of stations in the press, although it is possible that fewer articles may be processed. The press 10 is modified by the user to have different numbers of stations as needed.

The transfer of the articles along the multiple station press 10 is affected by a pair of gripper bars 26 extending along the transfer direction 24. The gripper bars 26 have grippers or other article engaging elements 28 mounted spaced along the transfer bars such that when the bars 26 are brought together, the grippers or other article engaging elements 28 engage the articles in such a way that the articles can be lifted and moved. The grippers or other article engaging elements 28 are available from a variety of manufacturers for handling articles of different shapes and sizes. The gripper bars 26 are generally formed by extruded members of a profile which permits the grippers or other elements 28 to be readily mounted to the gripper bars 28 at different positions and at different orientations, as needed.

One end of the gripper bars 26 extend beyond the press bed 12 to an endwise moving means 30. The endwise moving means 30 is supported on a support frame 32 extending from a side of the press 10. On the support frame 32 is mounted a drive 34 which moves two vertical rods 36 back and forth in the transfer direction 24. The drive 34 in one embodiment is a Star linear module MKR 35-165. The vertical rods 36 have mounted thereon sleeves 38 that are connected to the ends of each of the gripper bars 26. The sleeves 38 slide on the rods 36 as the gripper bars 26 are lifted and lowered. The endwise moving means 30 also includes a horizontal slide 40 on which the vertical rods 36 are mounted which accommodates the movement of the gripper bars 26 toward and away from one another. One vertical rod 36 is provided for each gripper bar 26 in the illustrated embodiment; however, it is contemplated to provide more than one rod in some arrangements for greater rigidity. For instance, two vertical rods 36 for each of the gripper bars 26 and two sleeves for the gripper bars, for a total of four vertical rods may be used. The four rod embodiment provides added rigidity to the apparatus.

The present press transfer device is also provided with a pair of lifting and gripping moving means 42 and 44. The lifting and gripping means 42 and 44 act to move the gripper bars 26 toward one another to grip articles in the transfer line 24 and then lift the gripped articles. After gripping, the gripper bars 26 are moved endwise in the transfer direction 24 by the endwise moving means 30. After the articles reach the next station in the multi-station press 10, the lifting and gripping means 42 and 44 lower the articles and move the gripper bars 26 apart to release the articles. The gripper bars 26 are moved far enough apart to clear the press ram 22 as it descends toward the bolster plate 14.

The lifting and gripping means 42 and 44 are together in a compact unit, two of which are provided in the illustrated embodiment. The lifting and gripping units 42 and 44 are adjacent the press bolster plate 14 adjacent the corresponding uprights 16. Although two such units are provided in the illustrated example, for longer presses or presses having more stations it foreseeable to include three or more of the lifting and gripping units. The units which include the lifting means and the grip moving means will be described in more detail hereinafter.

The present transfer device is electronically controlled by a controller 46 that monitors the operation of the press 10 through a link 48 to coordinate the press movements to the movements of the press transfer device. The controller is also connected to the endwise moving means 30 by a link 50, and to the lifting and gripping means 42 and 44 by links 52 and 54, respectively, in such a way as to monitor the movements of these elements and to control the motors and cylinders which affect the movements. In one embodiment, the controller is a CNC unit (computer numerical control) from Allen-Bradley.

Figure 2:
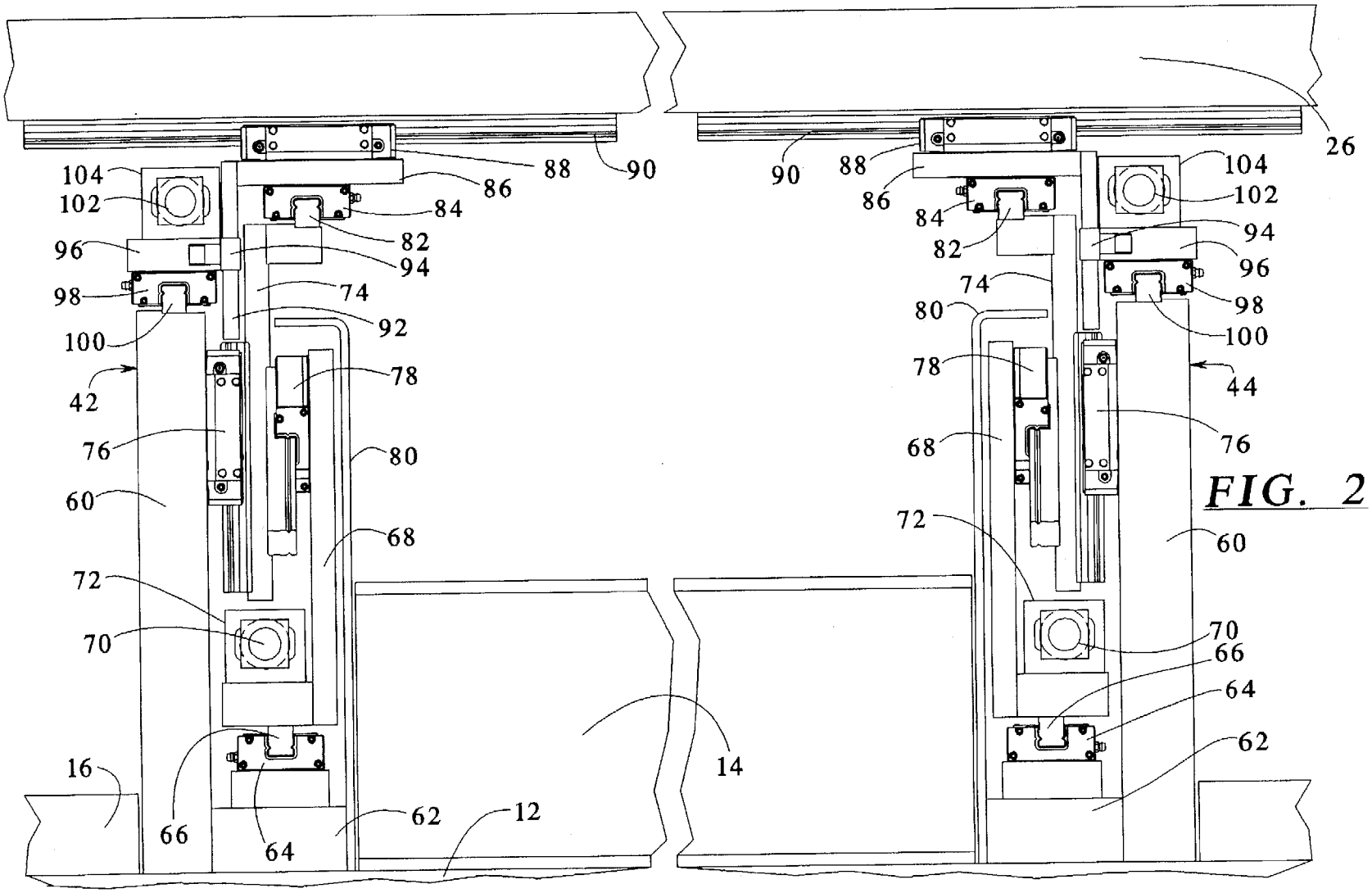
FIG. 2 is an end view of the pair of lifter means and gripper means from FIG. 1.

Referring now to FIG. 2, the two lifting and gripping means 42 and 44 are shown. The lifting and gripping means 42 and 44 are arranged in a mirror-image position, although it is also contemplated to position both with the same orientation. The lifting and gripping means 42, for example, is on the press bed 12 between the bolster plate 14 and the upright 16, only a portion of which is shown in this view. The lifting means includes a first plate serving as a support. The first plate 60 also has a floor mounting plate 62 extending therefrom and resting on the press bed 12. A horizontal bearing 64 is provided fixed relative to the stationarily mounted first plate 60, and is either on the first plate 60 or alternately on the floor mounting plate 62 or other stationary location. The horizontal bearing 64 is a linear bearing, such as an IKO rollerway bearing number LRWH25 or a bearing by THK, and includes a horizontal rail 66 on a second plate 68. A ball lead screw 70, for example, as manufactured by Saginaw, is mounted to the second plate 68. The lead screw is driven by a servo motor 72, such as a motor from Electro Craft, under the control of the CNC controller 46 to cause the second plate to move horizontally on the horizontal bearing 64.

The first plate 60 and the second plate 68 define a space therebetween in which is mounted a third plate 74. The third plate 74 is mounted to the first plate by a vertical bearing 76 and to the second plate 68 by an angled bearing 78. The bearings 76 and 78 are also linear bearings, such as IKO rollerway bearing number LRWH25. As the second plate 68 moves horizontally on the bearing 64, the angled bearing 78 causes the third plate 74 to move vertically in the vertical bearing 76. Horizontal motion is thereby translated to vertical motion. The linear bearings provide direct translation of the movement with little or no play.

A cover 80 is provided over the second plate 68 to shield the plate 68 from debris. The second lifting and gripping means 44 is provided at the opposite side of the bolster plate 14, this means having the same parts as the lifting and gripping means 42. The two units are operated together by the controller to lift and lower the gripper bars 26.

Having described the endwise, transfer movement and the lifting movement, the means for affecting the gripping movement will now be described. The upper end of the third plate, or lift plate, 74 is provided with a horizontal rail 82 on which rides a linear bearing 84. The bearing 84 is mounted on a gripper bar support 86 that has a bearing 88 on the upper side, the bearing 88 receiving a guide rail 90 for one of the gripper bars 26. The support 86 supports one of the gripper bars 26, while another such support supports the other gripper bar. The support 86 has a cam 92 extending downward from one side. The cam 92 is engaged by a cam roller 94, which is in the form of a sleeve through which the cam 92 may be moved vertically as the lifter plate 74 lifts and lowers the articles. The cam roller 94 is on a plate 96 that has a bearing 98 on the underside. The bearing 98 is supported on a rail 100 that is mounted on the top of the first, support plate 60. The plate 96 has a ball screw that interacts with a lead screw 102 driven by a servo motor 104.

Figure 3:
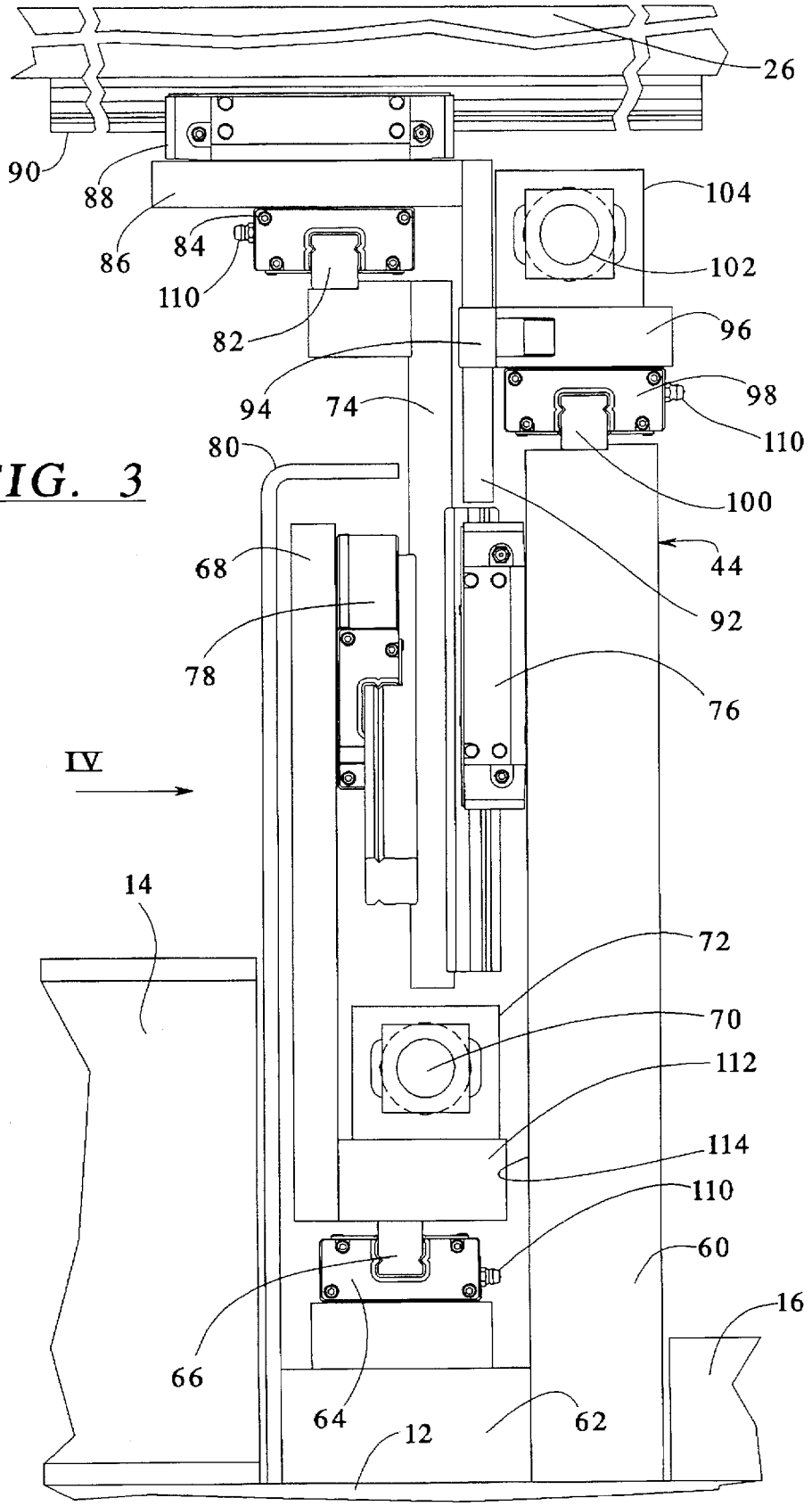
FIG. 3 is an enlarged end view of the lifter means and gripper means according to the present invention.

The other lifting and gripping unit 44 is shown in FIG. 3 somewhat enlarged compared to FIG. 2. The same reference characters have been used for the same or similar parts. As mentioned before, the mirror image arrangement of the second unit compared to the first unit is not required, the two lifting and gripping units may be arranged with the same orientation. Each of the bearings 64, 76, 78, 98 and 84 are provided with grease fittings 110 for lubricating the bearings. Preferably, the grease fittings are connected to an automatic lubricating system which feeds a predetermined amount of lubricant to the bearings at regular intervals during the operation of the present apparatus.

An alternative arrangement of the present apparatus may include a linear bearing between a portion 112 of the second plate 68 and a portion 114 of the first plate 60 instead of the linear bearing 64 as shown. Another alternative is to provide the gripper motor 104 and lead screw 102 supported on the lifter, third plate 74 instead of on the stationary first plate 60, although this embodiment involves lifting the weight of the motor 104 and lead screw 102 in addition to the gripper bars 26 and articles.

Figure 4:
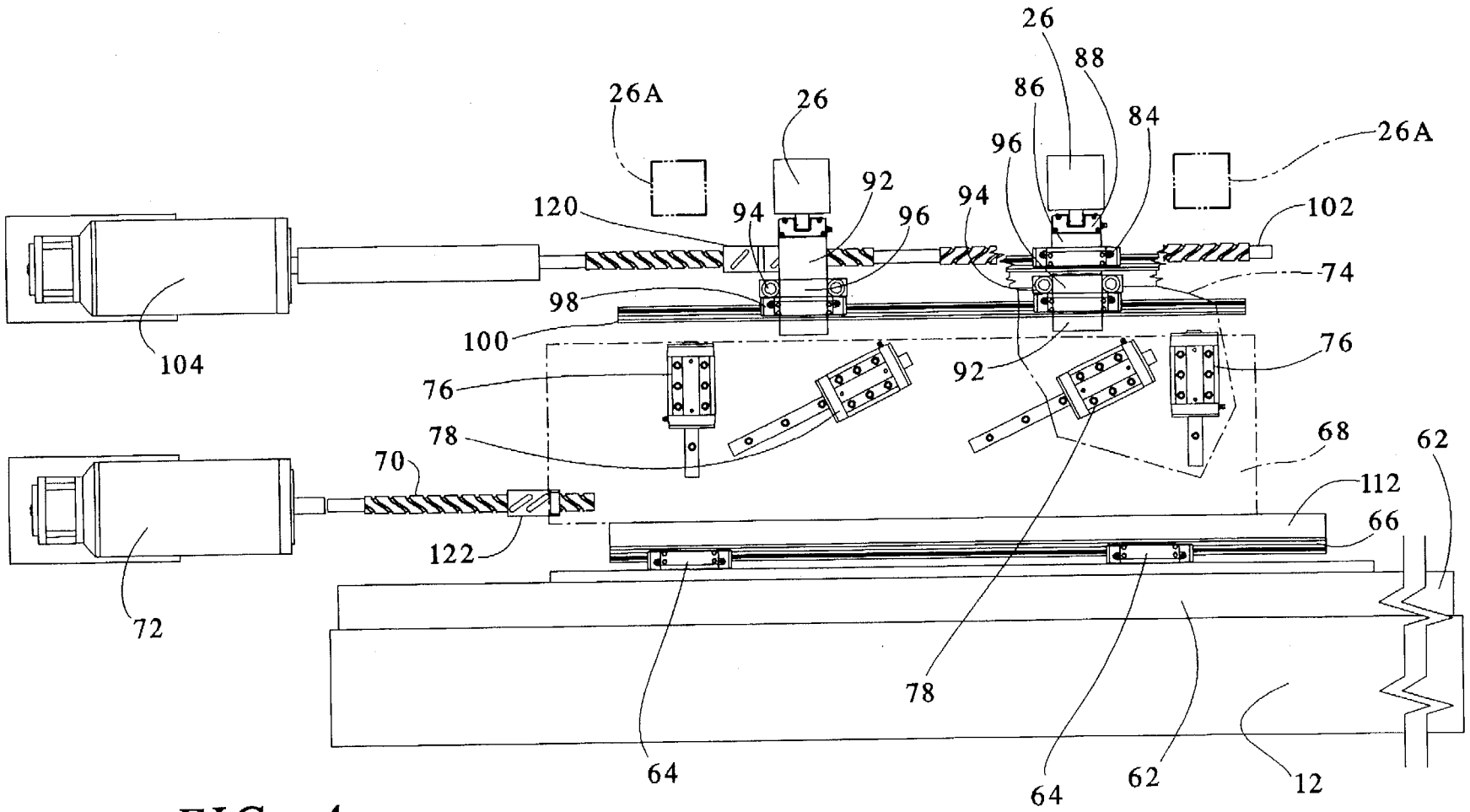
FIG. 4 is a side view of one of the lifter means and gripper means of FIG. 2.

FIG. 4 shows the lifting and gripping means of FIG. 3 generally from the direction IV (see FIG. 3) with the cover 80 removed and the second horizontally moving plate 68 rendered in phantom. The angled bearing 78 which is between the second plate 68 and third plate 74 can be seen. Two such angled bearings 78 are provided in the preferred embodiment, along with two vertical bearings 76 and two horizontal bearings 64. In one embodiment, the angled bearing is at an angle of approximately 26 degrees, specifically 25.6 degrees, which makes the tangent of the angle 0.5 for easy calculation of lift over horizontal travel. Other angles are, of course, possible. For instance, an angle of 30 degrees or 45 degrees is possible.

The relative arrangement of the gripper bars 26 and their supports 86 is also apparent from FIG. 4. In particular, the two gripper bars 26 are arranged side-by-side in a parallel arrangement. Operation of the gripper means moves both of the gripper bars 26 alternately toward one another, as shown in solid outline, or away from one another, as shown in broken outline at 26A. The gripper motor 104 is a reversible servo motor controlled by the controller 46, the motor 104 driving the lead screw 102. The lead screw 102 of the gripper means has right-hand threads on one side for one of the gripper bars 26 and left-hand threads on the other side for the other gripper bar 26. The plate 96 for the cam roller 94 is linked to the lead screw 102 by a ball screw 120 having ball bearing riding in the screw threads, such as a ball screw from Saganaw.

The movement of the ball screws 120 is transmitted to the gripper bars 26 by the cam 92 and cam roller 94 arrangement. The cam roller 94 moves laterally, pushing the cam 92, which is in the form of a vertical plate, in horizontal directions. The cam 92 extends to the support plate 86 on which the gripper bars 26 are mounted by the guide rail 90 and bearing 88. Horizontal movement of the gripper bars 26 and the support plates 86 is directed by the bearing 84 on the rail 82. The cam 92 is movable up or down in the cam roller 94 as a result of the lifting means, while moving the gripper bars 26 horizontally. Rotating of the lead screw 102 in one direction moves the gripper bars 26 together and rotating the lead screw 102 in the other direction moves the bars 26 apart.

The second plate 68 is moved by the reversible servo motor 72 which turns the lead screw 70. A ball screw 122 transmits the motion of the lead screw 70 to the second plate 68.

Both the servo motors 72 and 104 are supported in a casing (not shown) which may be connected to the stationary first plate 60 or to the press frame or other stationary support.

The lifting and gripping means is a compact unit that is mounted in the press by two bolts, so that it can be easily removed for repair or change-over for different articles. The simple construction and few moving parts makes maintenance and repair easy and inexpensive. The present transfer device has been used at a transfer rate of 60 parts per minute, and higher speeds are likely possible. Thus, the present apparatus can be used at the full speed of the press, rather than slowing the press to accommodate the transfer device.

Although other modifications and changes may be suggested by those skilled in the art, it is the intention of the inventors to embody within the patent warranted hereon all changes and modifications as reasonably and properly come within the scope of their contribution to the art.

We claim:

1. A press transfer mechanism for use on a multi-station press, comprising:

first and second elongated transfer bars extending generally parallel to a transfer line of the multi-station press;

transfer means for moving said first and second elongated transfer bars in endwise directions;

engaging means for moving said first and second elongated transfer bars alternately together and apart in a direction generally transverse to their length;

lift means for alternately lifting and lowering said first and second elongated transfer bars, said lift means comprising:

a first member mounted generally stationary relative to said multi-station press;

a second member having a first part adjacent said first member and a second part spaced from said first member to define a space;

a horizontal bearing between said first member and said first part of said second member to enable said second member to be moved generally horizontally in a direction transverse to the transfer line of the multi-station press;

a third member disposed in said space between said first member and said second part of said second member, said third member being connected to said first and second elongated transfer bars;

a vertical bearing between said first member and said third member to enable said third member to move generally vertically relative to said first member;

an angled bearing between said third member and said second part of said second member; and means for moving said second member in a horizontal direction relative to said first member so that said third member is caused to move in a vertical direction relative to said first member by action of said angled bearing.

2. A press transfer device as claimed in claim 1, wherein said first and second and third bearings are linear bearings.

3. A press transfer device as claimed in claim 1, wherein said engaging means is mounted on said third member between said third member and said first and second elongated transfer bars so that said engaging means is alternately lifted and lowered along with said first and second elongated transfer bars.

4. A press transfer device as claimed in claim 1, wherein said lifting means is a first lifting means adjacent a first end of said first and second elongated transfer bars, and further comprising:

a second lifting means generally identical to said first lifting means adjacent a second end of said first and second elongated transfer bars.

5. A press transfer device as claimed in claim 1, further comprising:

numeric controlled means connected to said engaging means and said transfer means and said lifting means to coordinate movements to cause an article at a station of said multi-station press to be engaged, lifted, transferred, lowered and disengaged so as to move the article to a next station of said multi-station press.

6. A press transfer device as claimed in claim 5, wherein said numeric controlled means is connected to said multi-station press to coordinate movements of said transfer device with cycles of said press.

7. A lift means for a press transfer system, comprising:

a stationary plate disposed extending in a vertical direction;

a first linear bearing mounted on a first side of said stationary plate in a horizontal direction;

a second linear bearing mounted on said first side of said stationary plate in a vertical direction;

a horizontally movable plate mounted to said first linear bearing for horizontal movement, said horizontally movable plate having a portion opposite said stationary plate at said second linear bearing and defining a space therebetween;

horizontal drive means for moving said horizontally movable plate in the horizontal direction;

a third linear bearing mounted on said horizontally movable plate at an angle between horizontal and vertical on said portion opposite said stationary plate; and a vertically movable plate disposed in said space between said stationary plate and said horizontally movable plate, said vertically movable plate being mounted to said second linear bearing at a first side and to said third linear bearing at a second side.

8. A lifting means as claimed in claim 7, wherein said third linear bearing is mounted at an angle of approximately 26 degrees from horizontal.

9. A lifting means as claimed in claim 7, further comprising:

a grip moving means mounted at least partially on said vertically movable plate;

a pair of gripper bars movable toward and away from one another by said grip moving means, said gripper bars extending along a transfer direction of a press.

10. A lifting means as claimed in claim 7, further comprising: grippers;

transverse moving means for moving said gripper, said transverse moving means including:

a gripper drive motor;

a lead screw connected to said gripper drive motor, said lead screw having right-hand threads on one portion and left-hand threads on another portion;

a first screw follower on said right-hand thread portion and a second screw follower on said left-hand thread portion;

a first cam roller connected to said first screw follower and a second cam roller connected to said second screw follower; and a first cam engaged by said first cam roller and a second cam engaged by said second cam roller, said first cam being connected to a first of said grippers and a second cam being connected to a second of said grippers so that operation of said gripper drive motor in a first direction moves said grippers toward one another and operation of said gripper drive motor in a second direction moves said grippers away from one another.

* * * * *